United States Patent [19]

Smith

[11] 4,042,106

[45] Aug. 16, 1977

[54] RECORD PROTECTOR

[76] Inventor: Paul W. Smith, 2818 Louisiana Ave. South, St. Louis Park, Minn. 55426

[21] Appl. No.: 721,554

[22] Filed: Sept. 8, 1976

[51] Int. Cl.[2] ..... B65D 85/30

[52] U.S. Cl. ..... 206/313; 211/40; 294/27 R

[58] Field of Search ..... 312/10, 12; 211/40, 211/41; 206/309, 310, 311, 312, 313; 229/68 R; 294/6, 27 R

[56] References Cited

U.S. PATENT DOCUMENTS

| | | | |
|---|---|---|---|
| 1,316,885 | 9/1919 | Fletcher | 206/311 |
| 2,500,773 | 3/1950 | Robins | 206/311 |
| 2,555,594 | 6/1951 | Markovitz | 206/309 |
| 2,725,143 | 11/1955 | Linebaugh et al. | 206/309 |
| 2,777,574 | 1/1957 | Brody | 312/10 |
| 2,881,913 | 4/1959 | Kursh | 206/313 |
| 3,004,659 | 10/1961 | Usher et al. | 206/313 |
| 3,102,635 | 9/1963 | Werwin et al. | 206/313 |
| 3,199,768 | 8/1965 | Farmlett | 206/312 |
| 3,876,134 | 4/1975 | Rice et al. | 206/312 |
| 3,961,819 | 6/1976 | Yocom | 229/27 R |

FOREIGN PATENT DOCUMENTS

| | | | |
|---|---|---|---|
| 639,445 | 4/1962 | Canada | 206/313 |
| 1,031,344 | 6/1953 | France | 312/10 |
| 1,317,316 | 1/1963 | France | 206/312 |
| 396,916 | 8/1933 | United Kingdom | 206/309 |
| 1,136,663 | 12/1968 | United Kingdom | 206/313 |

*Primary Examiner*—Stephen Marcus
*Assistant Examiner*—Bruce H. Bernstein
*Attorney, Agent, or Firm*—Burd, Braddock & Bartz

[57] ABSTRACT

A hand-held protector for permitting removal of a phonograph disc record from a record jacket, for placing the record on a phonograph spindle, for removing the record from the spindle and reinserting the record into a jacket, all without touching the record. The protector comprises a flat cap-like device which fits over a portion of the record but not extending as far as the central spindle engaging opening. It is intended to remain in the record jacket with the record. Desirably the record jacket includes an inner sleeve against which the open edge of the protector cap butts when the record is in place for storage.

6 Claims, 3 Drawing Figures

FIG. 1
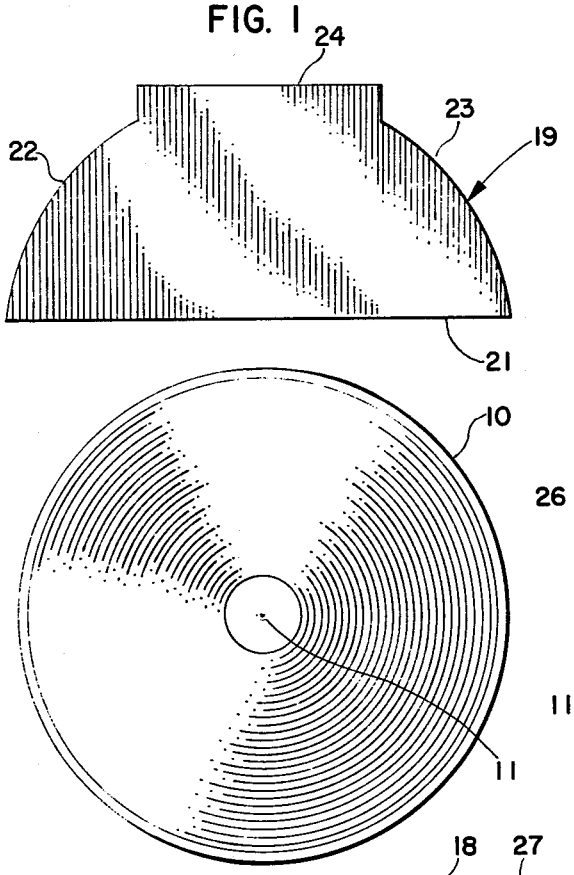
FIG. 2
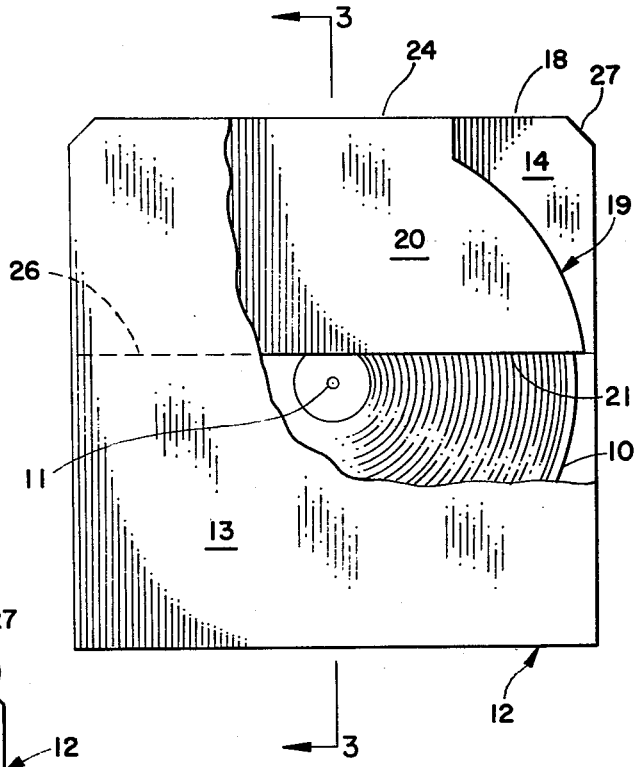
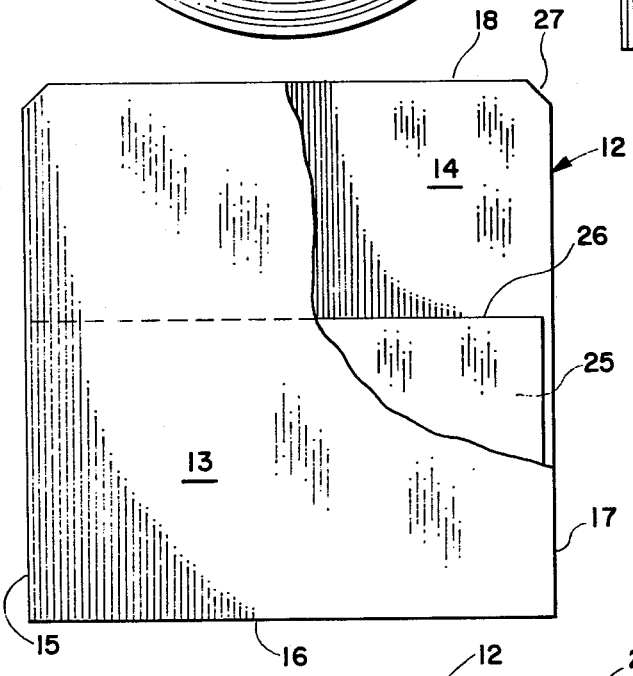
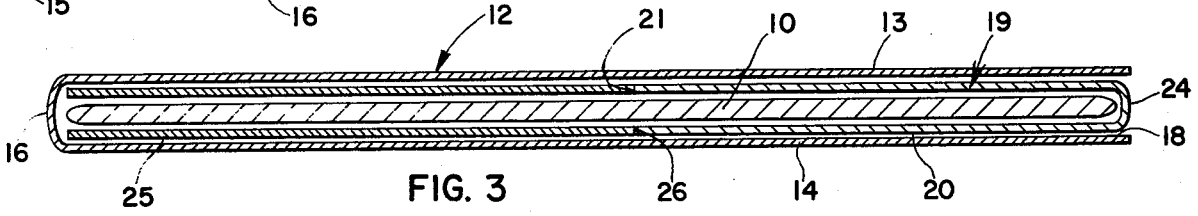
FIG. 3

RECORD PROTECTOR

BACKGROUND OF THE INVENTION

1. Field of the Invention

This invention is directed to a hand-held protector devicefor use in removing a phonograph disc record from a conventional record jacket, for placing the record on a phonograph spindle, for removing the record from the spindle and reinserting it into a jacket, all without touching the record.

One of the major sources of damage to phonograph records is manual handling. Record users are cautioned to avoid touching the record grooves and to always handle the record by its edges. However, it is virtually impossible to remove a record from its cardboard or paperboard jacket without touching the grooves. This is true even if the record is first inserted in an inner paper or plastic envelope before insertion into the jacket. Most records are made from polyvinyl chloride which is relatively soft. The grooves are extremely fine. The result is that the quality of sound reproduction deteriorates rapidly proportional to the degree of handling to which the record is subjected.

2. Prior Art

Markovitz U. S. Pat. No. 2,555,594 shows a phonograph disc record package designed to facilitate placing a stack of records in sleeves on a turntable without handling the records. This is accomplished by means of narrow aligned slots extending inwardly from the midpoint of the open sides of a multiple pack of record jackets to a point beyond the center of the jacket face so as to expose the spindle opening in the center of the record discs. Because the slot is in the outer protective covering, this record package has the disadvantage that a portion of the record disc underlying the slot remains exposed to possible damage through collection of dust, careless handling, etc.

Linebaugh et al. U. S. Pat. No. 2,725,143 discloses a similar multiple jacket record file for placing a stack of records on a phonograph turntable without handling the individual records. This device likewise includes a plurality of aligned slots extending inwardly from the midpoint of the open side of the several sleeves or jackets comprising the file to a point beyond the center so as to expose the spindle openings in the records contained in the file. This device has the same disadvantage of leaving a portion of the outermost records exposed and subject to possible damage.

Werwin et al. U. S. Pat. No. 3,102,635 shows a two-part composite package for records including an outer cover and an inner record holder. The inner holder, which is pivoted in the outer cover, has a generally V-shaped opening which is so located that when the inner holder is pivoted partially out from the outer cover, the spindle opening and a portion of the record label are exposed. In the closed position, the inner record holder covers the spindle openings. The disc is partially ejected automatically as the inner holder is pivoted to expose the opening and label. It is not suggested that this package be used as a means for putting the record disc on a phonograph spindle. Since both the inner holder and the outer cover remain together, it is awkward, and in some cases impossible, to use the holder to place the record disc on the spindle.

Yocum U. S. Pat. No. 3,961,819 shows a hand-held tool for removing a phonograph record from and reinserting the record in a record jacket without handling the record disc. This device may be used to place the disc on a phonograph spindle. It comprises a bifurcated cradle extending from a handle and having a semicircular inwardly directed groove for receiving a portion of the perimeter of the record. The tool is adapted to engage the outside of a record jacket from which the record is ejected by gravity into the record tool. This tool is not a part of the record package.

SUMMARY OF THE INVENTION

The present invention is directed to packaging means for phonograph disc records having a central spindle-engaging opening characterized by a hand-held protector device for permitting handling of the record without touching the record itself. The protector device comprises flat cap-like envelope open along one straight edge to receive a portion, less than half, of a record disc, the length of the envelope along that edge being less than the diameter of the disc. The maximum width of the envelope is less than the radius of the disc. The contours of the envelope correspond generally to the outer perimeter of the record. The envelope includes a straight handle portion whose edge lies parallel to the open straight edge, whose length it less than the length of the envelope and which is adapted to lie in alignment with the open edge of a record jacket when the record is in place in that jacket. The protective record jacket also includes a flat sleeve disposed in the end of the jacket opposite its open edge, the edges of the protective cap butting against the edges of the sleeve in the assembled record package.

BRIEF DESCRIPTION OF THE DRAWINGS

The invention is illustrated in the accompanying drawings in which:

FIG. 1 shows in exploded view a protective cap or envelope, a phonograph record disc and an outer protective jacket, shown partly broken away to reveal an inner sleeve;

FIG. 2 shows the same components assembled, partly broken away to show the interrelationship among the components; and FIG. 3 is a fragmentary section on the line 3—3 of FIG. 2.

DETAILED DESCRIPTION OF THE PREFERRED EMBODIMENT

Referring to the drawings, there is shown a phonograph disc record 10 of conventional structure and composition having a central spindle engaging opening 11 by which the record is properly positioned on a phonograph turntable. Such records are commonly distributed in square cardboard jackets or outer sleeves, indicated generally at 12, and comprised of a front panel 13 and a rear panel 14 joined along three edges 15, 16 and 17 and open along the remaining edge 18 to receive the record 10 therein. Each edge of the jacket is slightly longer than the diameter of the record to facilitate insertion and removal.

A protector cap, indicated generally at 19, which is in the form of an envelope, is adapted to fit over one side of the record to facilitate handling of the record disc. The cap or envelope 19 has front and rear faces 20 of sheet material in face-to-face abutment. The envelope is open along one straight edge 21 to receive the record disc. The sheet members are joined along edges 22, 23 and 24. Edges 22 and 23 are contoured to correspond generally in geometrical configuration to the perimeter of the disc. Preferably they are arcuate as shown, but they may be octagonal or some other polygonal shape.

Edge 24 defines a handle portion of the envelope. That edge is generally parallel to the open edge 21. The maximum length of the envelope along edge 21 is less than the diameter of the phonograph disc. The maximum width of the envelope is less than the radius of the disc. Accordingly, when the protective cap is in place, as shown in FIG. 2, the center of the record is uncovered leaving spindle opening 11 exposed. The length of the handle portion 24 is less than the length of the envelope. In the assembled package, edge 24 of the protective envelope 19 lies between the faces of the jacket and in longitudinal alignment with the face edges which comprise open edge 18 of the jacket.

Preferably the outer sleeve or jacket 12 includes an inner sleeve 25 composed of a pair of paper or cardboard sheets in face-to-face abutment. The sheets may be joined along their opposite side edges by separate joining means or by virtue of lying adjacent to the joined edges of the outer jacket panels. The inner sleeve is disposed within the jacket adjacent to its closed end and opposite from open edge 18. The inner sleeve is of rectangular configuration with an open edge 26 which extends across the width of the jacket and is adapted to receive that portion of the record which is not already received in envelope 19. The width of inner sleeve 25 is more than one-half the diameter of the record. It is equal to the width of the outer jacket minus the width of envelope 19 or, put another way, the combined widths of envelope 19 and inner sleeve 25 are substantially equal to the width of jacket 12 and in the assembled package. Edge 21 of envelope 19 butts against edge 26 of inner sleeve 25. Preferably the outer faces of inner sleeve 25 are secured adhesively or otherwise to the inner faces of the jacket to insure that the record enters the inner sleeve.

The protective cap 19 and inner sleeve 25 can either be incorporated as part of the original record package for new records or made available separately and incorporated into the storage jackets of existing records in one's collection. To facilitate entry of the protective cap into the jacket, the corners of the jacket adjacent edge 18 may be cut off about ¼ inch to 1 inch, as indicated at 27, or the side edges 15 and 17 may be split an equivalent distance from edge 18.

In use, the open edge 18 of the jacket 12 is bowed slightly to permit insertion of the fingers between the front and back jacket faces. However, instead of grasping the record edge directly between fingers and thumb, handle portion 24 of the protective cap or envelope 19 is grasped and through it pressure is exerted upon the record disc to permit withdrawal from the jacket. Then, while so holding the record, because the spindle hole 11 is exposed, the record may be placed directly on a phonograph turntable spindle and only then is the protective cap removed.

To remove the record from the turntable, one face of the protective cap is eased under the topmost record in the stack or between record and turntable if only a single record has been played and the cap is pushed inwardly toward the record center until the periphery of the record is firmly enveloped. Then the record can easily be removed from the turntable and reinserted in the jacket without fear of damage to the record. The protector cap may be formed from cardboard or paperboard similar to that of the record jacket, or it may be formed from semi-rigid synthetic resinous sheet material or molded in one piece from such material. Preferably the protector cap should be formed from a material having a Rockwell hardness less than that of the polyvinyl chloride from which the record is formed.

It is apparent that many modifications and variations of this invention as hereinbefore set forth may be made without departing from the spirit and scope thereof. The specific embodiments described are given by way of example only and the invention is limited only by the terms of the appended claims.

The embodiments of the invention in which an exclusive property or privilege is claimed are defined as follows:

1. A hand-held protector device for removing a phonograph disc record of a given diameter, said record having a central spindle engaging opening from a record jacket, for placing the record on a phonograph spindle, for removing the record from the spindle and reinserting in a record jacket, all without touching the record, said protector device comprising:

A) an envelope composed of a pair of flat sheet members in face-to-face abutment,
  1. said envelope being open along one straight edge and adapted to receive a record between the sheet members,
  2. the length of the envelope along said straight edge being less than the diameter of the phonograph disc,
  3. said sheet members being connected at their edges over at least a portion of the perimeter of said envelope which corresponds generally in geometrical configuration to the perimeter of the phonograph disc, and
  4. the maximum width of said envelope being less than the radius of the phonograph disc, and B. a straight handle portion on said envelope,
  1. the edge of said handle portion being generally parallel to said open edge, and
  2. the length of said edge being less than the length of the envelope.

2. A record protector device according to claim 1 further characterized in that said envelope is composed of material having a Rockwell hardness less than that of polyvinyl chloride from which record discs are formed

3. A phonograph record package comprising in combination:

A. a phonograph record jacket composed of square flat sheet members in closely spaced face-to-face relation joined together along three sides and open along one edge, B. an inner sleeve disposed in said jacket opposite from said open edge and comprised of:
  1. a pair of flat rectangular sheet members in closely spaced face-to-face relation,
  2. the length of said sheet members being substantially equal to the inside width of said jacket, and
  3. the width of said sleeve being more than one-half the width of said jacket, C. a protector device disposed in said jacket for removing a phonograph disc record of a given diameter, said protector device comprising:
  1. an envelope composed of a pair of flat sheet members in face-to-face abutment,
    a. said envelope being open along one straight edge and adapted to receive a record between the sheet members, b. the length of the envelope along said straight edge being less than the diameter of the phonograph disc, c. said sheet members being connected at their edges over at least a portion of the perimeter of said envelope which corresponds generally in geometrical configuration to the perimeter of the phonograph disc, and d. the maximum width of said envelope being less than the radius of the phonograph disc, and

2. a straight handle portion on said envelope, a. the edge of said handle portion being generally parallel to said open edge, and b. the length of said edge being less than the length of the envelope, the edge of the handle portion of said device being in substantial longitudinal alignment with the sheet member edges defining the open edge of the jacket, and the open straight edge of said device being in abutment with the edge of said inner sleeve, and D. a phonograph disc record disposed in said jacket between the sheet members of said protector device and said inner sleeve.

4. A package according to claim 3 further characterized in that said inner sleeve is adhesively secured within said jacket.

5. A package according to claim 3 further characterized in that the side edges of said jacket adjacent to said open edge are open for a distance of about ¼ to 1 inch from said open edge.

6. A package according to claim 5 further charcterized in that the corners between said side edges and open edge are cut off.

* * * * *